US007699256B2

(12) United States Patent
Kimura et al.

(10) Patent No.: US 7,699,256 B2
(45) Date of Patent: Apr. 20, 2010

(54) SPOOL, SPOOL UNIT, AND SPOOL UNIT PRODUCTION METHOD

(75) Inventors: Fujita Kimura, Kobe (JP); Katsuhiko Ishikawa, Kobe (JP)

(73) Assignee: Shimano, Inc., Sakai-shi (JP)

( * ) Notice: Subject to any disclaimer, the term of this patent is extended or adjusted under 35 U.S.C. 154(b) by 359 days.

(21) Appl. No.: 11/918,088

(22) PCT Filed: Oct. 2, 2006

(86) PCT No.: PCT/JP2006/319710

§ 371 (c)(1),
(2), (4) Date: Oct. 9, 2007

(87) PCT Pub. No.: WO2008/032420

PCT Pub. Date: Mar. 20, 2008

(65) Prior Publication Data

US 2009/0277989 A1 Nov. 12, 2009

(30) Foreign Application Priority Data

Sep. 15, 2006 (JP) ..... 2006-251736

(51) Int. Cl.
*B65H 75/06* (2006.01)

(52) U.S. Cl. ..... 242/171; 242/176; 242/588.1; 242/588.4; 242/588.6; 242/608.8; 242/610.2; 242/613.3; 242/901; 206/393

(58) Field of Classification Search ..... 242/170, 242/171, 174, 176, 472.7, 588, 588.1, 588.3, 242/588.4, 588.6, 600, 601, 603, 607.2, 608, 242/608.8, 610.1, 61.2, 613.2, 613.3, 118.41, 242/129, 222, 901; 206/391, 393, 395, 408
See application file for complete search history.

(56) References Cited

FOREIGN PATENT DOCUMENTS

| | | | |
|---|---|---|---|
| JP | 47-37418 | | 11/1972 |
| JP | 7-137933 | A | 5/1995 |
| JP | 9-188475 | A | 7/1997 |
| JP | 10-109822 | A | 4/1998 |
| JP | 10-109824 | A | 4/1998 |
| JP | 10-253836 | A | 9/1998 |
| JP | 11-5671 | A | 1/1999 |
| JP | 11-180641 | A | 7/1999 |
| JP | 2000-7068 | A | 1/2000 |
| JP | 2001-114471 | A | 4/2001 |
| JP | 2001-148987 | A | 6/2001 |
| JP | 2001-151206 | A | 6/2001 |
| JP | 2001-299173 | A | 10/2001 |

(Continued)

*Primary Examiner*—John Q Nguyen
*Assistant Examiner*—William E Dondero
(74) *Attorney, Agent, or Firm*—Birch, Stewart, Kolasch & Birch, LLP

(57) ABSTRACT

[Object] It is intended to provide a spool capable of winding and retaining a thread-like substance without causing a winding curling.

[Solving Means] This spool 11 has a base plate 14, thread retaining members 15 and 16, and auxiliary plates 17 and 18. The base plate 14 is made from a resin, paper, or the like and in the form of an elongated rectangle. The base plate 14 is folded at a central portion 21. The thread retaining members 15 and 16 are provided on opposite ends of the base plate 14. The auxiliary plates 17 and 18 are fixed to the thread retaining members 15 and 16 to form flanges. Ends of the auxiliary plates 17 and 18 are fixed to the base plate 14.

4 Claims, 13 Drawing Sheets

FOREIGN PATENT DOCUMENTS

| | | | |
|---|---|---|---|
| JP | 2002-84943 | A | 3/2002 |
| JP | 2002-95399 | A | 4/2002 |
| JP | 2002-171887 | A | 6/2002 |
| JP | 2002-369646 | A | 12/2002 |
| JP | 2002-370871 | A | 12/2002 |
| JP | 2003-9742 | A | 1/2003 |
| JP | 2004-215636 | A | 8/2004 |
| JP | 2004-215637 | A | 8/2004 |
| JP | 2004-313150 | A | 11/2004 |
| JP | 2005-151 | A | 1/2005 |
| JP | 2005-218334 | A | 8/2005 |
| JP | 2005-218446 | A | 8/2005 |
| JP | 2005-304358 | A | 11/2005 |
| JP | 2006-223127 | A | 8/2006 |
| JP | 2006-230207 | A | 9/2006 |

SPOOL, SPOOL UNIT, AND SPOOL UNIT PRODUCTION METHOD

TECHNICAL FIELD

This invention relates to a structure of a spool for retaining a thread-like substance such as a fishing line and a suture thread. Also, this invention relates to a spool unit on which the thread-like substance such as the fishing line and the suture thread is wound in such a fashion that the thread-like substance is dispensed freely therefrom and a production method for the spool unit.

RELATED ART

A fishing line, for example, has heretofore been sold as being cut to a predetermined length (50 to 150 m, for example). Since such long fishing line is inconvenient for handling, the fishing line is usually sold in a state of being wound on a spool (see Patent Publications 1 to 14, for example). The spool ordinarily has a cylindrical core, and the fishing line is wound on the core. Apparatuses for winding the fishing line on the spool have heretofore been provided (see Patent Publications 15 to 25, for example). Such apparatuses wind the fishing line on the core in a state where a constant tension being generated on the fishing line.

Patent Publication 1: JP-A-2006-230207
Patent Publication 2: JP-A-2006-223127
Patent Publication 3: JP-A-2005-304358
Patent Publication 4: JP-A-2005-218446
Patent Publication 5: JP-A-2005-218334
Patent Publication 6: JP-A-2005-000151
Patent Publication 7: JP-A-2004-313150
Patent Publication 8: JP-A-2004-215637
Patent Publication 9: JP-A-2004-215636
Patent Publication 10: JP-A-2003-009742
Patent Publication 11: JP-A-2002-370871
Patent Publication 12: JP-A-2002-369646
Patent Publication 13: JP-A-2002-171887
Patent Publication 14: JP-A-2001-299173
Patent Publication 15: JP-A-2002-095399
Patent Publication 16: JP-A-2002-084943
Patent Publication 17: JP-A-2001-151206
Patent Publication 18: JP-A-2001-148987
Patent Publication 19: JP-A-2001-114471
Patent Publication 20: JP-A-11-180641
Patent Publication 21: JP-A-11-005671
Patent Publication 22: JP-A-10-109824
Patent Publication 23: JP-A-10-109822
Patent Publication 24: JP-A-9-188475
Patent Publication 25: JP-A-9-137933

DISCLOSURE OF THE INVENTION

Problems to be Solved by the Invention

A curling can be imparted to the fishing line due to the winding on the cylindrical core. With such winding curling, the fishing line can undesirably be in the form of a spiral to make it difficult for an angler to use the fishing line. In order to solve the trouble, the spools disclosed in Patent Publications 11 and 15, for example, have been proposed, and the winding curling seldom occurs on fishing lines wound on such spools. However, since the conventional spools were insufficient for perfectly eliminating the winding curling, there has been a demand for realization of a spool that is free from the winding curling of fishing line.

Also, the suture thread is sold in the state of being wound on a spool. The suture thread is used by a doctor for suturing tissues of an incision, laceration, or the like with the tissues being closely contacted. In the suturing, if the suture thread has the winding curling, it will be difficult for the doctor to conduct an operation safely. In view of the safety of medical care, there is a demand for realization of a spool free from the winding curling of suture thread.

This invention has been accomplished under the above-described circumstances. A first object of this invention is to provide a spool capable of retaining a thread-like substance such as a fishing line and a suture thread without causing a winding curling and enabling a person who uses the thread-like substance to easily dispense a desired length of the thread-like substance as well as a spool unit in which the thread-like substance is provided on the spool. A second object of this invention is to provide a method for producing the spool unit.

Means for Solving the Problems (1) A spool according to this invention comprises a base plate having a central portion and end portions. The base plate is capable of changing its posture between a folded posture in which the base plate is bent at the central portion so that the end portions are opposed to each other and an expanded posture in which the end portions are departed from each other symmetrically. The base plate is provided with a pair of thread retaining members. The thread retaining members are disposed on the end portions in such a fashion that the thread retaining members are opposed to each other when the base plate is in the folded posture. Each of the thread retaining members is provided with a peripheral surface that enables a thread-like substance to take on a smooth curvature when the thread-like substance is wound on the thread retaining members.

The thread-like substance is wound on the spool to be retained on the spool. More specifically, the base plate is changed to the expanded posture. The pair of thread retaining members are disposed on the end portions of the base plate in the state where the base plate is in the expanded posture. Then, one end of the thread-like substance is fixed to a predetermined position on the base plate, e.g. on an intermediate position between the pair of thread retaining members. The thread-like substance is wound on one of the thread retaining members. The thread-like substance may be wound clockwise or anticlockwise on the thread retaining member. Then, the thread-like substance is wound on the other thread retaining member. The thread-like substance is wound on the thread retaining members to cross with each other between the thread retaining members. That is, in the case where the thread retaining member is wound clockwise on one of the thread retaining members, the thread-like substance is wound anticlockwise on the other thread retaining member. Alternatively, in the case where the thread-like substance is wound anticlockwise on one of the thread retaining members, the thread-like substance is wound clockwise on the other thread retaining member. The thread-like substance is wound alternately and continuously on the pair of thread retaining members in the above-described manner, so that the long thread-like substance is retained on the base plate. The posture of the base plate is changed to the folded posture with the thread-like substance being retained on the base plate. Thus, the thread-like substance wound on the pair of the thread retaining members in the crossing fashion forms a ring like shape in the base plate.

Since the thread-like substance is wound alternately on the pair of thread retaining members in the crossing fashion as described above, the thread-like substance is wound remarkably moderately without being pulled strongly. Since the posture of the base plate is changed to the folded posture with the thread-like substance being wound on the thread retaining members, the thread-like substance is formed into the ring-like shape, and a tension generated on the thread-like substance is almost null. Accordingly, the thread-like substance is retained on the base plate in the near-nontension state, so that a winding curling will not be generated on the thread-like substance. Further, it is possible for a user of the thread-like substance to dispense a desired length of the thread-like substance from the base plate by pulling the other end of the thread-like substance retained on the base plate. The thread-like substance wound on the thread retaining members is dispensed alternately from the thread retaining members in such a manner that the thread-like substance is unraveled from each of the thread retaining members. Therefore, the thread-like substance will never be dispensed from the base plate in such a length that is much longer than the user desired.

(2) An auxiliary plate forming a flange may preferably be provided on each of end faces of the thread retaining members opposed to each other when the base plate is in the folded posture.

The auxiliary plates form the flanges of the thread retaining members. Therefore, advantages that work of winding the thread-like substance on the thread retaining members is facilitated and the thread-like substance once wound on the thread retaining members does not come off easily from the thread retaining members are achieved.

(3) The base plate may preferably be in the form of an elongated rectangle, and each of the thread retaining members may preferably be in the form of a column with the peripheral surface being in the form of a circular arc. Also, each of the auxiliary plates is formed of a flange portion fixed to the end face of the thread retaining member and a fixing portion of which one end is continuous from the flange portion. The fixing portion may preferably extend to a longitudinal direction of the base plate so that the other end is fixed to the central portion of the base plate. A length of the fixing portion in a direction orthogonal to the longitudinal direction of the base plate may preferably be reduced gradually toward the center of the base plate.

With such constitution, since the base plate and the thread retaining members have the simple shapes, an advantage of suppression in production cost of the spool is achieved. Also, since the outer shape of the spool is the form of a rectangular parallelepiped, the spool is easy to hold for the user. Further, the flange portions of the auxiliary plates facilitate the work of winding the thread-like substance on the thread retaining members and prevent the thread-like substance once wound on the thread retaining members from easily coming off from the thread retaining members. Further, since side rims of the fixing portions of the auxiliary plates are tapered, the thread-like substance is guided along the side rims of the fixing portions when the thread-like substance is wound on the thread retaining members.

Therefore, an advantage of further facilitating the work of alternately winding the thread-like substance on the thread retaining members is achieved.

(4) The spool according to this invention may have the following constitution. The spool comprises a main body. The main body has a first main wall and a second main wall disposed parallel to each other. Each of the first main wall and the second main wall may be formed from a square or rectangular plate-like substance. For the shape of the first main wall and the second main wall, various shapes such as a circular shape, an elliptical shape, and an oval shape may be adopted. One end of the first main wall and one end of the second main wall is connected to each other by a connector, and the other end of the first main wall and the other end of the second main wall are not connected. That is, the other end of the first main wall and the other end of the second main wall are open ends. As the connector, a plate like substance may be used. The connector fully connects the ends of the first main wall to the second main wall. The connector may be disposed with an appropriate gap being defined in a direction of the end to connect the ends of the first main wall and the second main wall intermittently.

A first projection member is provided on an inner surface of the first main wall in such a fashion as to project toward the second main wall. At least a portion of the first projection member positioned near the open end is curved to project toward the open end. Likewise, a second projection member is provided on an inner surface of the second main wall in such a fashion as to project toward the first main wall. At least a portion of the second projection member positioned near the open end is curved to project toward the open end. The first projection member and the second projection member may preferably be opposed to each other. Also, each of the portions near the open ends of the first projection members and the second projection members may be in the form of a circular arc or an elliptic arc, for example.

A first piece member extends from the connector on the inner surface of the first main wall toward the open end. An intermediate portion of a back face of the first piece member is connected to a projected end face of the first projection member. A front rim of the first piece member near the open end is curved to project toward the open end. Also, a second piece member extends from the connector on the inner surface of the second main wall toward the open end. An intermediate portion of a back face of the second piece member is connected to a projected end face of the second projection member. A front rim of the second piece member near the open end is curved to project toward the open end. At least tips of the first piece member and the second piece member near the open end are flexible. Each of the front rim of the first piece member and the front rim of the second piece member may be in the form of a circular arc or an elliptic arc, for example.

The main body, the first projection member, the second projection member, the first piece member, and the second piece member may be formed from a flexible material such as a synthetic resin and a paper.

The thread-like substance (e.g. fishing line or suture thread) is hooked on the first projection member and the second projection member. A leading end of the thread-like substance is disposed near the open end. The thread-like substance is wound in such a fashion as to be crossed between the first projection member and the second projection member (in the form of a numerical character 8) and folded at the crossed portion (at the center between the first projection member and the second projection member).

In the spool with such constitution, a rear end of the thread-like substance is fixed in the vicinity of the first projection member, for example. The thread-like substance is wound on a portion of the first projection member positioned near the open end to be returned near the connector and then wound on a portion of the second projection member near the open end to be returned near the connector. In this state, the thread-like substance is set between the first piece member/the second piece member and the first main wall/the second main wall and is not unraveled spontaneously. When the thread-like substance is pulled, a part of the thread-like substance in the vicinity of the first projection member bends the tip of the first piece member to move to a surface of the first piece member. When the thread-like substance is further pulled in this state, a part of the thread-like substance in the vicinity of the connector and a part of the thread-like substance in the vicinity of the connector and the second projection member are unraveled. When the thread-like substance is pulled further, a part of the thread-like substance in the vicinity of the second projection member bends the tip of the second piece member to move to a surface of the second piece member. After that, the thread-like substance is dispensed in the same manner.

In this spool, since the thread-like substance is wound in the form of a numerical character 8 on the first projection member and the second projection member, the thread-like substance does not have the winding curling when the thread-like substance is unraveled. Since it is possible to unravel the thread-like substance only by linearly pulling the leading end of the thread-like substance, work of dispensing the thread-like substance is facilitated.

A width of the first piece member may be gradually reduced toward the connector from the portion connected to the projected end face of the first projection member. Likewise, a width of the second piece member may be gradually reduced toward the connector from the portion connected to the protected end face of the second projection member. With such constitution, the first piece member and the second piece member do not disturb the movement of the thread-like substance when the thread-like substance is dispensed, thereby enabling the thread-like substance to be dispensed rapidly.

The main body may preferably be housed in a predetermined case. When the main body is housed in the case, the spool is conveniently portable.

(5) A spool unit according to this invention comprises a base plate having a central portion and end portions. The base plate is capable of changing its posture between a folded posture in which the base plate is bent at the central portion so that the end portions are opposed to each other and an expanded posture in which the end portions are departed from each other symmetrically. The base plate is provided with a pair of thread retaining members. The thread retaining members are disposed on the end portions in such a fashion that the thread retaining members are opposed to each other when the base plate is in the folded posture. Each of the thread retaining members is provided with a peripheral surface that enables a thread-like substance to take on a smooth curvature when the thread-like substance is wound on the thread retaining members. The spool unit further comprises a long thread-like substance wound on one of the thread retaining members and subsequently on the other thread retaining member in a state where the base plate is in the expanded posture, the thread-like substance being wound on the pair of thread retaining members as being crossed between the pair of thread retaining members; a casing for housing and retaining the thread-like substance, the thread retaining members, and the base plate with the base plate being in the folded posture; and a guiding member for guiding the thread-like substance from inside to outside of the casing.

The thread-like substance is wound on the base plate. The thread-like substance is wound to be retained on the base plate by a process described below. The thread-like substance is dispensed from the base plate by a process described below.

The posture of the base plate is changed to the expanded posture. The pair of thread retaining members are disposed on the end portions of the base plate in the state where the base plate is in the expanded posture. Then, one end of the thread-like substance is fixed to a predetermined position on the base plate, e.g. on an intermediate position between the pair of thread retaining members. The thread-like substance is wound on one of the thread retaining members. The thread-like substance may be wound clockwise or anticlockwise on the thread retaining member. Then, the thread-like substance is wound on the other thread retaining member. The thread-like substance is wound on the other thread retaining member to cross with each other. That is, in the case where the thread retaining member is wound clockwise on one of the thread retaining members, the thread-like substance is wound anticlockwise on the other thread retaining member. Alternatively, in the case where the thread-like substance is wound anticlockwise on one of the thread retaining members, the thread-like substance is wound clockwise on the other thread retaining member. The thread-like substance is wound on the pair of thread retaining members alternately and continuously in the same manner, so that the long thread-like substance is retained on the base plate. The posture of the base plate is changed to the folded posture with the thread-like substance being retained on the base plate, so that the base plate is housed in the casing. Thus, the thread-like substance wound on the pair of the thread retaining members in the crossing fashion forms a ring like shape in the base plate and retained in the casing together with the base plate. The end of the thread-like substance is inserted into the guiding member to be lead outside the casing.

Since the thread-like substance is wound alternately on the pair of thread retaining members in the crossing fashion, the thread-like substance is wound remarkably moderately without being pulled strongly. Since the posture of the base plate is changed to the folded posture with the thread-like substance being wound on the thread retaining members, the thread-like substance is formed into the ring-like shape, and a tension generated on the thread-like substance is almost null. Accordingly, the thread-like substance is retained on the base plate in the near-nontension state, so that a winding curling will not be generated on the thread-like substance. Further, it is possible for a user of the thread-like substance to dispense a desired length of the thread-like substance from the casing (i.e. from the base plate) by pulling the thread-like substance lead out from the guiding member. The thread-like substance wound on the thread retaining members is dispensed alternately from the thread retaining members in such a manner that the thread-like substance is unraveled from each of the thread retaining members. Therefore, the thread-like substance will never be dispensed from the base plate in such a length that is much longer than the user desired.

(6) The guiding member may preferably have a tube provided with an insertion hole for inserting the thread-like substance, and the insertion hole may preferably be increased in diameter gradually toward an inner part of the casing.

Since the insertion hole is increased in diameter as described above, the thread-like substance smoothly proceeds from the inside of the casing into the guiding member. Therefore, the thread-like substance is not bent when proceeding into the guiding member, so that the thread-like substance is prevented from being damaged.

(7) The spool unit may further comprise: an attachment member to which the plural casings are attached and a retaining belt which is fixed on a hip of a user of the thread-like substance so as to allocate the attachment member on an abdominal part of the user.

It is possible for the user of the thread-like substance to carry the plural spool units by wearing the retaining belt on the hip. Therefore, it is possible for the user of the thread-like substance to manage plural thread-like substances quickly.

(8) A spool unit production method according to this invention comprises: a step of winding, on a spool comprising: a base plate having a central portion and end portions and capable of changing a posture between a folded posture in which the base plate is bent at the central portion so that the end portions are opposed to each other and an expanded posture in which the end portions depart from each other symmetrically and a pair of thread retaining members disposed on the end portions of the base plate in such a fashion that the thread retaining members are opposed to each other when the base plate is in the folded posture, wherein each of the thread retaining members has an peripheral surface that enables a thread-like substance wound thereon to take on a smooth curvature, the thread-like substance on the pair of thread retaining members as being crossed between the pair of thread retaining members by winding the thread like substance on one of the thread retaining members and subsequently on the other thread retaining member in a state where the base plate is in the expanded posture; a step of changing the posture of the base plate to the folded posture with the thread-like substance being wound on the thread retaining members; and a step of housing and retaining the base plate in the folded posture in an enclosing manner in a state where the thread-like substance can be dispensed.

According to the production method, the spool is produced separately from the thread-like substance, and the spool unit is completed by winding the thread-like substance on the spool. In other words, since it is possible to separately produce the spool in a bulk amount, the spools are produced efficiently as component parts, thereby reducing a component part cost. Likewise, since the thread-like substances separately produced in a bulk amount are efficiently wound on the spools, a cost for work of winding the thread-like substance on the spool is reduced. Therefore, an advantage of producing the spool units efficiently and at low cost is achieved. Further, since the spool is provided with the base plate capable of changing its posture as describe above, once the thread-like substance is used up, it is possible to wind another thread-like substance on the same spool by changing the posture of the base plate to the expanded posture. That is, it is possible to reuse the spool and to suppress generation of garbage.

EFFECT OF THE INVENTION

The spool according to this invention enables a thread-like substance to be wound without a winding curling. Therefore, in the spool unit in which the thread-like substance is wound on the spool, a straight and smooth state of the thread-like substance is maintained when the thread-like substance is dispensed from the spool. As a result, when the thread-like substance is a fishing line, the fishing line is prevented from being deteriorated due to the winding curling, so that the fishing line is disposed in water with being free from winding curling. When the thread-like substance is suture thread, a doctor is enabled to conduct suturing rapidly and accurately.

BEST MODE FOR CARRYING OUT THE INVENTION

Embodiment 1

FIG. 1 is a perspective view showing a spool unit 10 according to Embodiment 1 of this invention. FIG. 2 is an exploded perspective view showing the spool unit 10.

The spool unit 10 is provided with a spool 11, a thread-like substance 12 wound and retained on the spool 11, and a casing 13 for housing the thread-like substance 12 and the spool 11. The thread-like substance 12 is a fishing line in this embodiment. Therefore, the spool unit 10 according to this embodiment is formed as a fishing line unit in which the fishing line is wound on the spool.

FIG. 3 is an enlarged perspective view showing the spool 11. FIG. 4 is a plan view showing the spool 11, and FIG. 5 is a sectional view showing a section taken along the V-V line of FIG. 4.

As shown in FIGS. 2 and 3, the spool 11 is provided with a base plate 14, thread retaining members 15 and 16, and auxiliary plates 17 and 18.

The base plate 14 is made from a resin, a paper, a metal, or the like. The base plate 14 is formed from a thin flat plate and has an elongated rectangular shape. The base plate 14 is bent at a first position 19 and a second position 20 at a central portion 21. It is possible to change a posture of the base plate 14 between a posture of extending straight as shown in FIG. 3 (expanded posture) and a posture of being bent as shown in FIG. 2 (folded posture). When the base plate 14 is in the folded posture, both ends of the base plate 14 are opposed to each other (see FIGS. 2 and 9). When the base plate 14 is in the expanded posture, the both ends of the base plate 14 are departed from each other symmetrically (see FIGS. 3 and 4).

Each of the thread retaining members 15 and 16 is made form a resin, a wood, a metal, or the like. It is possible to wound the thread-like substance 12 on the thread retaining members 15 and 16 in the manner described later in this specification. In this embodiment, the thread retaining member 15 has a column-like shape.

Accordingly, a peripheral surface 22 of the thread retaining member 15 is in the form of a circular arc, and the thread-like substance 12 wound on the thread retaining member 15 takes on the circular arc shape. The thread retaining member 15 is disposed at one end of the base plate 14 and projected from an inner surface 23 of the base plate 14. A length in an axial direction of the thread retaining member 15 (A height of the thread retaining member in a vertical direction in FIG. 3) is set to 5 to 10 mm, for example. The length can be changed as required depending on a diameter of the thread-like substance 12.

The thread retaining member 16 has a structure similar to that of the thread retaining member 15. Specifically, the thread retaining member 16 has a column-like shape, and a peripheral surface 24 thereof is in the form of a circular arc. Accordingly, the thread-like substance 12 wound on the thread retaining member 16 takes on the circular arc shape. The thread retaining member 16 is disposed at the other end of the base plate 14 and projected from the inner surface 23 of the base plate 14 like the thread retaining member 15.

Specifically, the thread retaining member 16 is disposed at a position symmetrical with the thread retaining member 15 with respect to the central portion 21. A length in the axial direction of the thread retaining member 16 is set to 5 to 10 mm like the thread retaining member 15. Note that the length of the thread retaining member 16 is changed depending on the length of the thread retaining member 15 and set to a length same as that of the thread retaining member 15. Therefore, when the base plate 14 is in the folded posture, an end face 25 of the thread retaining member 15 and an end face 26 of the thread retaining member 26 are opposed to each other.

Though the thread retaining members 15 and 16 have the column-like shape in this embodiment, the shape of the thread retaining members 15 and 16 is not limited to the column-like shape. Various shapes may be adopted insofar as the thread-like substance wound on the thread retaining members 15 and 16 takes on a smooth curvature. Therefore, the thread retaining members 15 and 16 may be in the form of a column with a crescent-shaped section or may be in the form of a column of a different type with a curved surface being formed on a part of its peripheral surface.

The auxiliary plate 17 is made from a resin, a metal, or the like. The auxiliary plate 17 is formed from a thin flat plate. As shown in FIGS. 3 and 5, the auxiliary plate 17 is attached to the end face 25 of the thread retaining member 15. As a means for attaching the auxiliary plate 17, it is possible to employ a known fixing means such as an adhesive and heat welding. In this embodiment, the auxiliary plate 17 is provided with a flange portion 27 and a fixing portion 28, which are formed integrally. As shown in FIG. 5, a portion outside a bending portion 29 of the auxiliary plate 17, i.e. a portion at one end of the base plate 14, forms the flange portion 27. The flange portion 27 is disposed in parallel with the base plate 14. Therefore, the flange portion 27 and the base plate 14 form a flange provided on an upper end and on a lower end of the thread retaining member 15 respectively.

The fixing portion 28 is formed continuously from the flange portion 27 and extends in the direction of the other end of the base plate 14. One end of the fixing portion 28 is continuous from the flange portion 27, and the continuous portion forms the bending portion 29. The other end of the fixing portion 28 is fixed to the first position 19 of the base plate 14. Therefore, the fixing portion 28 is inclined downward to the base plate 14 from the end of the flange portion 27 as shown in FIG. 5. In this embodiment, a side rim 30 of the fixing portion 28 is inclined as shown in FIG. 4. That is, a length D in a width direction of the fixing portion 28 (length in a direction orthogonal to a longitudinal direction of the base plate 14) is reduced gradually toward the center of the base plate 14. More specifically, the length D becomes the maximum at the position where the fixing portion 28 is continued from the flange portion 27 and becomes the minimum at the position where the fixing portion 28 is fixed to the base plate 14.

The auxiliary plate 18 is made from a resin, metal, or the like and has a structure similar to that of the auxiliary plate 17. In FIG. 3, the auxiliary plate 18 in a standing posture is illustrated for the purpose of showing the structure of the auxiliary plate 18 and the thread retaining member 16 with clarity. In actuality, the auxiliary plate 18 is fixed to the thread retaining member 16. As shown in FIGS. 14 and 15, the auxiliary plate 18 is disposed symmetrically with the auxiliary plate 17. The auxiliary plate 18 is formed from a thin flat plate. The auxiliary plate 18 is attached to an end face 26 of the thread retaining member 16. As a means for attaching the auxiliary plate 18, it is possible to employ a known fixing means such as an adhesive and heat welding.

In this embodiment, the auxiliary plate 18 is provided with a flange portion 31 and a fixing portion 32, which are formed integrally. As shown in FIG. 5, a portion outside a bending portion 33 of the auxiliary plate 18, i.e. a portion at the other end of the base plate 14, forms the flange portion 31. The flange portion 31 is disposed in parallel with the base plate 14, and the flange portion 31 and the base plate 14 form a flange provided on an upper end and on a lower end of the thread retaining member 16 respectively.

The fixing portion 32 is formed continuously from the flange portion 31 and extends in the direction of one end of the base plate 14. One end of the fixing portion 32 is continuous from the flange portion 31, and the continuous portion forms the bending portion 33. The other end of the fixing portion 32 is fixed to the second position 20 of the base plate 14. Therefore, the fixing portion 32 is inclined downward to the base plate 14 from the end of the flange portion 31 as shown in FIG. 5. In this embodiment, a side rim 34 of the fixing portion 32 is inclined as shown in FIG. 4. That is, a length D in a width direction of the fixing portion 32 (length in a direction orthogonal to a longitudinal direction of the base plate 14) is reduced gradually toward the center of the base plate 14. More specifically, the length D becomes the maximum at the position where the fixing portion 32 is continued from the flange portion 31 and becomes the minimum at the position where the fixing portion 32 is fixed to the base plate 14. Effect of the change in the widthwise length D of the fixing portion 28 and the fixing portion 32 will be described later in this specification.

As shown in FIGS. 1 and 2, the casing 13 has a rectangular parallelepiped box-like shape. In this embodiment, the casing 13 is formed from a resin, a paper, or the like. The casing 13 has an opening formed on its front face, and a housing 35 is defined inside the casing 13 continuously from the opening. The housing 35 houses the base plate 14 in the folded posture. The housing 35 is formed in accordance with an outer shape of the base plate 14 in the folded posture. Therefore, in a state where the base plate 14 is housed in the housing 35 along a direction of an arrow 37 in FIG. 2, the base plate 14 is retained by the casing 13 with a predetermined retaining force.

The casing 13 is provided with a front cover 36. The front cover 36 is formed integrally with the casing 13 and capable of opening and closing the opening of the housing 35. The front cover 36 is provided with a surface fastener 38 (see FIG. 1). The surface fastener 38 has a hook tape 39 and a loop tape 40 (see FIG. 2). The loop tape 40 is provided on the casing 13, and the hook tape 39 is provided inside the front cover 36. Therefore, when the front cover 36 is closed, the hook tape 39 and the loop tape 40 are engaged with each other so that the closed state of the front cover 36 is maintained.

FIG. 6 is an enlarged sectional view showing a main part of the front cover 36.

As shown in FIGS. 1 and 2, the front cover 36 is provided with a guide ring 41 (guiding part). The guide ring 41 is made from a resin, a metal, or the like. The guide ring 41 is typically made from SiC (silicon carbide). As shown in FIG. 6, the guide ring 41 has a tube-like shape. The guide ring 41 penetrates through the front cover 36 and fixed to the front cover 36. More specifically, the guide ring 41 is provided with a ring main body 42 and a fixture 43. The ring main body 42 is provided with a through hole 44, and the fixture 43 is provided with a through hole 45. The ring main body 42 is fitted into the front cover 36 as penetrating through the front cover 36 from the inside of the front cover 36. Therefore, the ring main body 42 and the fixture 43 sandwiches the front cover 36 in cooperation with each other so that the guide ring 41 is mounted on the front cover 36.

In a state where the guide ring 41 is mounted on the front cover 36, a connection is provided between the through holes 44 and 45, so that an insertion hole 46 for providing connection between inside and outside the casing 13 is formed. The thread-like substance 12 is inserted into the insertion hole 46 to be guided smoothly from the inside to the outside of the casing 13. In this embodiment, a diameter of a part of the insertion hole 46 is increased. More specifically, an inner diameter of the through hole 44 is increased gradually toward the inside of the casing 13. That is, the insertion hole 46 is in the form of a funnel opened toward the inside of the casing 13. Effect of the shape of the insertion hole 46 will be described later in this specification.

FIG. 7 is an enlarged sectional view showing a main part of the casing 13.

As shown in FIGS. 1 and 2, the casing 13 is provided with a thread holder 47. As shown in FIG. 7, the thread holder 47 is formed from a circular flat plate.

The thread holder 47 has a central portion 48 and an outer rim portion 49, and the outer rim portion 49 is continuous from a rim of the central portion 48 and bent slightly upward. The thread holder 47 temporarily retains the thread-like substance 12. More specifically, a leading end of the thread-like substance 12 dispensed from the casing 13 is pressed into a gap 50 between the casing 13 and the outer rim portion 49 (see FIG. 7) as shown in FIG. 1. Thus, the thread-like substance 12 is held by the thread holder 47. When the thread-like substance 12 is pulled, the thread-like substance 12 is readily released from the thread holder 47.

FIG. 8 is a diagram schematically showing a winding process of the thread-like substance 12. FIG. 8(*a*) is a plan view, and FIG. 8(*b*) is a side view.

As described in the foregoing, the thread-like substance 12 is the fishing line. One end 51 of the thread-like substance 12 is fixed to the inner surface 23 of the base plate 14 when the posture of the base plate is changed to the expanded posture. Though the fixing position of the thread-like substance 12 is not particularly limited, the thread-like substance 12 is fixed near the central portion 21 of the base plate 14 in this embodiment. The thread-like substance 12 is lead between the base plate 14 and the auxiliary plate 17 to the thread retaining member 15 to be wound clockwise on the peripheral surface 22 of the thread retaining member 15. Then, the thread-like substance 12 is lead from between the base plate 14 and the auxiliary plate 17 to between the base plate 14 and the auxiliary plate 18 to be wound anticlockwise on the peripheral surface 24 of the thread retaining member 16. Further, the thread-like substance 12 is lead from between the base plate 14 and the auxiliary plate 18 to between the base plate 14 and the auxiliary plate 17. Thus, the thread-like substance 12 is lead so as to cross with the thread-like substance 12. Then, after the thread-like substance 12 is wound clockwise on the peripheral surface 22 of the thread retaining member 15, the thread-like substance 12 is wound on the thread retaining member 16 in the same manner as described above. That is, the thread-like substance 12 is wound alternately on the thread retaining member 15 and the thread retaining member 16 to cross with each other and to form the shape of a numerical character 8.

Though the thread-like substance 12 is wound clockwise on the thread retaining member 15 and wound anticlockwise on the thread retaining member 16 in this embodiment, it is possible to wind the thread-like substance 12 clockwise on the thread retaining member 16 and anticlockwise on the thread retaining member 15. In short, it is sufficient that the thread-like substance 12 is wound alternately on the thread retaining member 15 and the thread retaining member 16 in the crossing fashion. When a predetermined length (for example, 150 m in the case of fishing line) of the thread-like substance 12 is wound on the spool 11, the thread-like substance 12 is cut, and then the other end 52 of the thread-like substance 12 is lead to the outside of the spool 11 (see FIG. 8).

FIG. 9 is a side view showing the spool 11 when the posture of the base plate 14 is changed to the folded posture.

In the state where the thread-like substance 12 is wound on the spool 11 as described in the foregoing, the posture of the base plate 14 is changed to the folded posture. Thus, the thread-like substance 12 forms a ring like shape. The spool 11 is then housed in the casing 13 as shown in FIG. 2. When housing the spool 11 in the casing 13, the front cover 36 of the casing 13 is opened for insertion of the spool 11 into the casing 13. In other words, the spool 11 is enclosed and retained by the casing 13. The other end 52 of the thread-like substance 12 is inserted into the guide ring 41 provided on the front cover 36, and the front cover 36 is closed with the thread-like substance 12 being inserted into the guide ring 41. Thus, the thread-like substance 12 is drawn outside the casing 13 to complete the spool unit 10. It is possible for a user (angler) of the thread-like substance 12 to take out a desired length of the thread-like substance 12 by pulling out the thread-like substance 12.

Since the thread-like substance 12 is wound on the pair of thread retaining members 15 and 16 in the crossing fashion in the state where the base plate 14 of the spool 11 is in the expanded posture in the spool unit 10 described above, the thread-like substance 12 is wound remarkably moderately without being pulled strongly. Since the posture of the base plate 14 is changed to the folded posture with the thread-like substance 12 being wound on the thread retaining members 15 and 16, the thread-like substance 12 is formed into the ring-like shape, and a tension generated on the thread-like substance 12 is almost null. Accordingly, the thread-like substance 12 is retained on the base plate 14 in the near-nontension state, so that the thread-like substance 12 is free from a winding curling. Therefore, when the angler dispenses the thread-like substance 12 (fishing line) from the spool 11, the thread-like substance 12 is so straight that the angler can handle the fishing line with ease and enjoy comfortable fishing. This thread-like substance 12 is not limited to the fishing line and may be a suture thread. In the case of the suture thread, since the thread-like substance 12 maintains the straight state when a doctor dispenses the thread-like substance 12 from the spool 11, an advantage of enabling the doctor to perform suturing fast and accurately in operations is achieved.

Further, it is possible for the user of the thread-like substance 12 to dispense a desired length of the thread-like substance 12 only by pulling the thread-like substance 12. The thread-like substance 12 is dispensed in such a manner that the thread-like substance 12 is unraveled from the thread retaining members 15 and 16. Therefore, the thread-like substance 12 will never be dispensed in such a length that is much longer than the user desired.

In this embodiment, the spool 11 is provided with the auxiliary plates 17 and 18 (see FIG. 5). The auxiliary plate 17 forms the flange provided on the thread retaining member 15, and the auxiliary plate 18 forms the flange provided on the thread retaining member 16.

Therefore, the work of winding the thread-like substance 12 on the thread retaining members 15 and 16 is facilitated. As a result, a cost for the work of winding the thread-like substance 12 on the thread retaining members 15 and 16 is reduced. Further, once the thread-like substance 12 is wound on the thread retaining members 15 and 16, the thread-like substance 12 will not come off easily from the thread retaining members 15 and 16. As a result, it is possible to prevent the thread-like substance 12 from being tangled inside the casing 13 of the spool unit 10.

Also, since the base plate 14 and the thread retaining members 15 and 16 have the remarkably simple structures, an advantage of suppressing an increase in production cost of the spool 11 is achieved. Also, the shape of the spool unit 10 is in the form of a rectangular parallelepiped when the posture of the base plate 14 is changed to the folded posture. Therefore, the spool unit 10 has the outer shape that is easy to handle for the user. Further, as shown in FIG. 4, the widthwise length D of each of the fixing portion 18 of the auxiliary plate 17 and the fixing portion 32 of the auxiliary plate 18 is gradually reduced toward the center of the base plate 14. In other words, each of the side rim 30 of the auxiliary plate 17 and the side rim 34 of the auxiliary plate 18 is tapered as shown in FIG. 8. With such tapering, the thread-like substance 12 is guided along the side rims 30 and 34 when wound on the thread retaining members 15 and 16. Therefore, an advantage of further facilitating the work of winding the thread-like substance 12 on the thread retaining members 15 and 16 is achieved.

The spool unit 10 according to this embodiment is provided with the guide ring 41 as shown in FIGS. 1 and 2. By the guide ring 41, an advantage of smoothly dispensing the thread-like substance 12 from the inside of the spool 11 is achieved. Particularly, since a part of the insertion hole 46 of the guide ring 41 is increase in diameter as shown in FIG. 6, the thread-like substance 12 enters the guide ring 41 smoothly from the inside of the casing 13. Since the thread-like substance 12 is not bent when entering the guide ring 14, the thread-like substance 12 is prevented from being damaged.

In the spool unit 10 according to this embodiment, the spool 11 is produced separately from the thread-like substance 12 and is completed by the steps of: winding the thread-like substance 12 on the spool 11; changing the posture of the base plate 14 to the folded posture; and housing the spool 11 in the casing 13. In other words, since it is possible to produce the spools 11 alone and in a bulk amount, it is possible to efficiently produce the spool 11 as a component part, thereby reducing a cost for component part. Likewise, since the thread-like substances 12 that have been produced separately in a bulk amount are wound on the spools 11, a cost for the work of winding the thread-like substance 12 on the spool 11 is reduced. As a result, an advantage of efficient and low cost production of the spool unit 10 is achieved.

Further, since the spool 11 is provided with the base plate 14 that is capable of the posture change as described in the foregoing, once the thread-like substance 12 is used up, it is possible to wind another thread-like substance 12 on the same spool 11 by changing the posture of the base plate 14 to the expanded posture. That is, it is possible to reuse the spool 11 and to suppress generation of garbage.

Embodiment 2

Hereinafter, Embodiment 2 of this invention will be described.

FIG. 10 is an exploded perspective view of a spool unit 60 according to Embodiment 2 of this invention.

A spool 86 is housed in a case 61. The case 61 is formed of an inner box 62 and an outer box 63. The inner box 62 has a rectangular bottom wall 64, side walls 65 and 66 formed integrally with the bottom wall 64, end walls 67 and 68 formed integrally with the bottom wall 64, a locking member 69 formed integrally with the end wall 67, and a locking member 70 formed integrally with the end wall 68. The side wall 65 is formed continuously from one longitudinal rim of the bottom wall 64, and the side wall 66 is formed continuously from the other longitudinal rim of the bottom wall 64. The end wall 67 is formed continuously from one lateral rim of the bottom wall 64, and the end wall 68 is formed continuously from the other lateral rim of the bottom wall 64. The locking member 69 is formed continuously from an upper rim of the end wall 67, and the locking member 70 is formed continuously from an upper rim of the end wall 68. The end wall 67 is provided with a through hole 71 for dispensing a thread, which will be described later in this specification. The outer box 63 has the shape of a hollow and flat rectangular parallelepiped. The outer box 63 has a structure that walls on opposite ends are omitted.

FIG. 11 is a diagram showing a length of the thread dispensed from the spool 86.

The spool 86 has an upper wall 72 (first main wall) and a lower wall 73 (second main wall) as shown in FIG. 11(*a*). Each of the upper wall 72 and the lower wall 73 is in the form of a rectangle, and the upper wall 72 and the lower wall 73 are identical size. The upper wall 72 and the lower wall 73 are opposed to each other with a predetermined distance being defined therebetween and in parallel to each other. One of lateral rims of the upper wall 72 is connected to one of lateral rims the lower wall 73 by an end wall 74 (connector). The end wall 74 is disposed in such a fashion as to cover whole part of the lateral rims of the upper wall 72 and the lower wall 73 and substantially orthogonal to the upper wall 72 and the lower wall 73. With such constitution, the spool 86 has a substantially C-shape, and an end opposite to the end wall 74 is an open end. The upper wall 72, the lower wall 73, and the end wall 74 form a main part 98. In this embodiment, a closing member 87 is provided on the open end. The closing member 87 is provided on the lower wall 73 near the open end to close the open end.

On a backside of the upper wall 72, i.e. on a surface opposed to the lower wall 73, a short cylindrical member 76 (first projection) is provided. The short cylindrical member 76 is disposed on the upper wall 72 and near the open end. The short cylindrical member 76 is positioned at the center of the lateral rim of the upper wall 72. On a backside of the lower wall 73, i.e. on a surface opposed to the upper wall 72, a short cylindrical member 77 (second projection) is provided. The short cylindrical member 77 is disposed on the lower wall 73 and near the open end. The short cylindrical member 77 is positioned at the center of the lateral rim of the lower wall 73. The short cylindrical member 77 corresponds to the short cylindrical member 76. The short cylindrical members 76 and 77 are identical in size. Since each of the short cylindrical members 76 and 77 has a circular shape in a plan view, each of the short cylindrical members 76 and 77 has a curved portion that is projected toward the open end.

On the back side of the upper wall 72, a tongue member 78 (first piece member) is formed. A rear end of the tongue member 78 is fixed in the vicinity of the end wall 74. The tongue member 78 has an enlarged portion 79, an intermediate portion 80, and a tip portion 81. A width (length in a lateral direction of the upper wall 72) of the enlarged portion 79 is increased gradually toward the open end. A width of the intermediate portion 80 is constant. The tip portion 81 is continuous from the intermediate portion 80. A central axis line of the tongue member 78 is perpendicular to a central axis of the short cylindrical member 76. The width of the intermediate portion 80 is slightly less than a width of the upper wall 72. A projecting end portion of the short cylindrical member 76 is fixed to a part of the intermediate portion 80 opposed to the upper wall 72. The tip portion 81 has the shape of a circular arc and is projected toward the open end.

On the back side of the lower wall 73, a tongue member 82 (second piece member) is formed. The tongue member 82 has the shape similar to that of the tongue member 78. The tongue member 82 has an enlarged portion 83, an intermediate portion 84, and a tip portion 85, which have shapes similar to those of the enlarged portion 79, the intermediate portion 80, and the tip portion 81. A central axis line of the tongue member 82 is perpendicular to a central axis of the short cylindrical member 77. A width of the intermediate portion 84 is slightly less than a width of the lower wall 73. A projecting end portion of the short cylindrical member 77 is fixed to a part of the intermediate portion 84 opposed to the lower wall 73. The tip portion 85 has the shape of a circular arc and is projected toward the open end.

FIG. 12 is a diagram showing a state in which the main body 98 of the spool 86 is expanded, wherein (a) is a plan view, and (b) is a side view.

The spool 86 is formed from a rectangular heavy paper, for example, that is folded at a position indicated by a dashed line as shown in FIG. 8(*a*). When the heavy paper is folded as described above, the main body 98 having the closing member 87 is formed. The short cylindrical members 76 and 77 and tongue members 78 and 82 may be formed from the heavy paper. In such case, the short cylindrical members 76 and 77 and the tongue members 78 and 82 may be adhered by using an adhesive. Therefore, the tip portions 81 and 85 of the tongue members 78 and 82 are flexible. The main body 98, the short cylindrical members 76 and 77, and the tongue members 78 and 82 may be formed from materials other than the paper, such as a synthetic resin.

For instance, a fishing line is wound on the spool 86 by the following process.

One of the longitudinal rims of the lower wall 73 will be referred to as the longitudinal rim 89, and the other longitudinal rim will be referred to as the longitudinal rim 90. One of the longitudinal rims (longitudinal rim on the side of the longitudinal rim 89) of the upper wall 72 will be referred to as the longitudinal rim 91, and the other longitudinal rim (longitudinal rim on the side of the longitudinal rim 90) will be referred to as the longitudinal rim 92. One of rims (rim in the vicinity of the longitudinal rim 91) of the enlarged portion 79 will be referred to as the rim 93, and the other rim (rim in the vicinity of the longitudinal rim 92) will be referred to as the rim 95. One of rims (rim in the vicinity of the longitudinal rim 89) of the enlarged portion 83 will be referred to as the rim 94, and the other rim (rim in the vicinity of the longitudinal rim 90) will be referred to as the rim 96.

A rear end of the fishing line 88 is fixed to the lower wall 73 or in the vicinity of the longitudinal rim 89 of the enlarged portion 83 of the tongue member 82. The fishing line 88 is lead between the tongue member 82 and the lower wall 73 to the short cylindrical member 77 to be wound thereon. Thus, the fishing line 88 is returned to the longitudinal rim 90 to cross with a part of the rim 96 of the enlarged portion 83 of the tongue member 82 and then lead to the center of the end wall 74. By this work, the fishing line 88 is formed into a substantially elliptical ring.

The fishing line 88 is further lead to the longitudinal rim 91 of the upper wall 72 to cross with the rim 93 of the enlarged portion 79 of the tongue member 78, thereby entering between the tongue member 78 and the upper wall 72. The fishing line 88 is wound on the short cylindrical member 76 to be returned to the longitudinal rim 92 and then crosses with the rim 95 of the enlarged portion 79 to be lead to the end wall 74. Further, the fishing line 88 is lead to the longitudinal rim 89 of the lower wall 73 to cross with the rim 94 of the enlarged portion 83, thereby entering between the tongue member 82 and the lower wall 73. Thus, the fishing line 88 is wound once to be in the form of a numerical character 8. The fishing line is wound alternately on the short cylindrical members 76 and 77 in the same manner. The state in which the fishing line 88 is wound once is shown for the purpose avoiding complication.

The leading end of the fishing line 88 is drawn outside from an intermediate portion of the tip portion 81 of the tongue member 78 after passing through the through hole 97 formed on the center of the closing member 87 as shown in FIG. 12(*a*), for example. The leading end of the fishing line 88 may be drawn out from an intermediate part of the tip portion 85 of the tongue member 82 in some cases. After that, the heavy paper is folded at the position indicated by the dashed line in FIG. 12(*a*) to be in the form shown in FIG. 11(*a*). In this state, the fishing line 88 in the form of the numerical character 8 is folded at the center to be in the form of a ring.

As shown in FIG. 10, the main body 98 is housed in the inner box 62. The closing member 87 of the spool 86 is housed in the inner box 62. When housing the closing member 87, the housing member 87 is positioned close to the end wall 67 of the inner box 62. The fishing line 88 drawn out from the closing member 87 is drawn outside from the through-hole of the end wall 67 of the inner box 62. Then, the heavy paper is folded in such a fashion that the locking members 69 and 70 are in parallel with the bottom wall 64, and, in this state, the inner box 62 is housed in the outer box 63.

As shown in FIG. 11(*a*), in the case where the leading end of the fishing line 88 passes through the through-hole 97 after being crossed at the intermediate portion of the tongue member 82 and lead between the tongue members 78 and 82, the fishing line 88 bends the tip portion 85 of the tongue member 82 toward the upper wall 72 when the leading end of the fishing line 88 is pulled upward, so that a part of the fishing line 88 placed between the tongue member 82 and the lower wall 73 is moved to between the tongue members 78 and 82 (see FIG. 11(*b*)). When the fishing line is further pulled in this state, a part of the fishing line 88 in the vicinity of the end wall 74 passes the rim 93 of the tongue member 78 to be moved to the vicinity of the closing member 87 of the short cylindrical member 78 (see FIG. 11(*c*)). When the fishing line is pulled further in this state, the tongue member 78 is bent toward the tongue member 82, so that a part of the fishing line 88 in the vicinity of the end wall 74 and the short cylindrical member 76 is moved to between the tongue members 78 and 82 (see FIG. 11(*d*)). When the fishing line is pulled further in this state, the returning part of the fishing line 88 in the vicinity of the end wall 74 is dispensed (see FIG. 11(*e*)). Thus, the fishing line 88 wound on the short cylindrical members 76 and 77 is dispensed by a length of one winding. In the case of further dispensing the fishing line 88, the work shown in FIG. 11 is repeated.

Since the fishing line 88 is wound in the form of the numerical character 8, the fishing line 88 is free from the winding curling when dispensed. Also, the worker can dispense the fishing line 88 easily only by linearly pulling the fishing line 88.

Though the spool 86 is formed from the heavy paper in this embodiment, materials other than the heavy paper may be used for the spool 86. For example, various materials such a metal, a rubber, and a synthetic resin may be used for forming the spool 86. Also, though the case 61 has the inner box 62 and the outer box 63 in this embodiment, the case 61 may be formed only of the outer box 63. The inner box 62 and the outer box 63 may be formed from a transparent material so that the main body 98 can be seen through, or the inner box 62 and the outer box 63 may have a watertight structure. Further, a case 4 may be attached detachably to clothes of an angler by providing the outer box 63 with a fastener at an appropriate part. Though the closing member 87 is provided in this embodiment, the closing member 87 may be omitted.

Embodiment 3

Hereinafter, Embodiment 3 of this invention will be described.

FIG. 13 is a perspective view showing a spool unit 100 according to Embodiment 3 of this invention.

The spool unit 100 is provided with the spool unit 10 according to Embodiment 1 and a holder 101 for retaining the spool unit 10. It is possible for an angler to ware the holder 101 on the hip, for example, so that the angler can fish while wearing the holder 101. The spool unit 10 retained in the holder 101 has a structure similar to that shown in FIGS. 1 to 9. Therefore, description for the spool unit 10 is omitted. In this embodiment, since four spool units 10 are retained in the holder 101, four types of thread-like substances 12 are retained in the spool unit 100. The number of the spool units 10 to be retained in the holder 100 is not particularly limited.

The holder 101 is provided with a front plate 102 (attachment member) and a retaining belt 103. The front plate 102 is made from a flexible resin or rubber. The front plate 102 is in the form of an elongated belt and has a pair of attachment members 104 and 105 and a connecting member 106. The angler wears the holder 101 with the front plate 102 being pressed against the abdominal part. When the front plate 102 is pressed against the abdominal part, the front plate 102 is deformed along the abdominal part to fit the body of the angler.

The connecting member 106 is formed by notching a central portion of the front plate 102. With such connecting member 106, the front plate 102 is deformed in accordance with the shape of the body of the angler. In the case where the front plate 102 is flexible enough, the connecting member 106 may be omitted.

The attachment members 104 and 105 are formed symmetrically with each other. In the state where the angler wears the holder 101, the attachment member 104 is positioned on the right of the abdominal part of the angler, and the attachment member 105 is positioned on the left of the abdominal part of the angler. Two spool units 10 are mounted on each of the attachment members 104 and 105. Thus, since two types of fishing lines are retained on each of the right side and the left side of the abdominal part, the angler can use an appropriate fishing line and change fishing lines efficiently during the fishing.

Each of the spool units 10 is attached to the front plate 102 via a surface fastener, for example. That is, a hook tape is fixed to one of the spool unit 10 and the front plate 102, and a loop tape is fixed to the other one of the spool unit 10 and the front plate 102. Also, the spool unit 10 may be attached to the front plate 102 by fixing the casing 13 (see FIG. 2) forming the spool unit 10 to the front plate 102. In this case, the casing 13 is fixed to the front plate 102 with an adhesive or the like.

Further, though the spool unit 10 is exposed to the front face of the front plate 102 in this embodiment, the front plate 102 may be provided with a pocket for housing the spool unit 10. In this case, the pocket may preferably be provided with a pocket main body and a cover. The pocket main body is provided with an opening for taking in and out the spool unit 10 and a capacity for perfectly housing the spool unit 10. The cover may preferably be connected to the pocket main body via a fastener. The fastener may preferably be a watertight fastener, and the opening of the pocket main body is easily opened/closed by operation of the faster by the angler. The angler operates the fastener to open the opening, thereby housing the spool unit 10 in the pocket main body or taking out the spool unit 10 from the pocket main body. The cover may preferably be provided with a hole for dispensing the thread-like substance 12. In this case, the thread-like substance 12 dispensed from the spool unit 10 is inserted into the hole of the cover to be lead to the outside. Thus, it is possible for the angler to take out the thread-like substance 12 without operating the cover.

The retention belt 103 is made form a resin such as nylon. In this embodiment, the retention belt 103 is divided into two parts and provided with belt pieces 107 and 108 and a buckle 109 for connecting the belt pieces 107 and 108. One end 112 of the belt piece 107 is connected to a right end of the front plate 102. One end 113 of the belt piece 108 is connected to a left end of the front plate 102. A male piece 110 of the buckle 109 is fixed to the other end of the belt piece 107, and a female piece 111 of the buckle 109 is fixed to the other end of the belt piece 108. In FIG. 13, the male piece 110 and the female piece 111 are engaged with each other, and the belt pieces 107 and 108 are connected to each other. When the buckle 109 is operated, the engagement of the male piece 110 and the female piece 111 is released, so that the belt pieces 107 and 108 are separated from each other. Since the buckle 109 has a known structure, description for the buckle 109 is omitted.

It is possible for the angler to carry the plural spool units 10 by wearing the spool unit 100 for fishing. Since the spool unit 100 is provided with the retention belt 103, it is possible for the angler to wear the spool unit 100 easily only by winding the retention belt 103 on the hip in the state where the front plate 102 being pressed against the abdominal part. Since the plural spool units 10 are attached to the front plate 102, it is possible for the angler to manage an optimum fishing line quickly depending on the situation of a fishing point as described above. It is needless to mention that, since the spool unit 10 is the fishing line unit 10 according to Embodiment 1, the spool unit 100 has the advantages of the spool unit 10 that the dispensed fishing line is free from the winding curling and so forth.

DESCRIPTION OF REFERENCE NUMERALS

Figure 1:
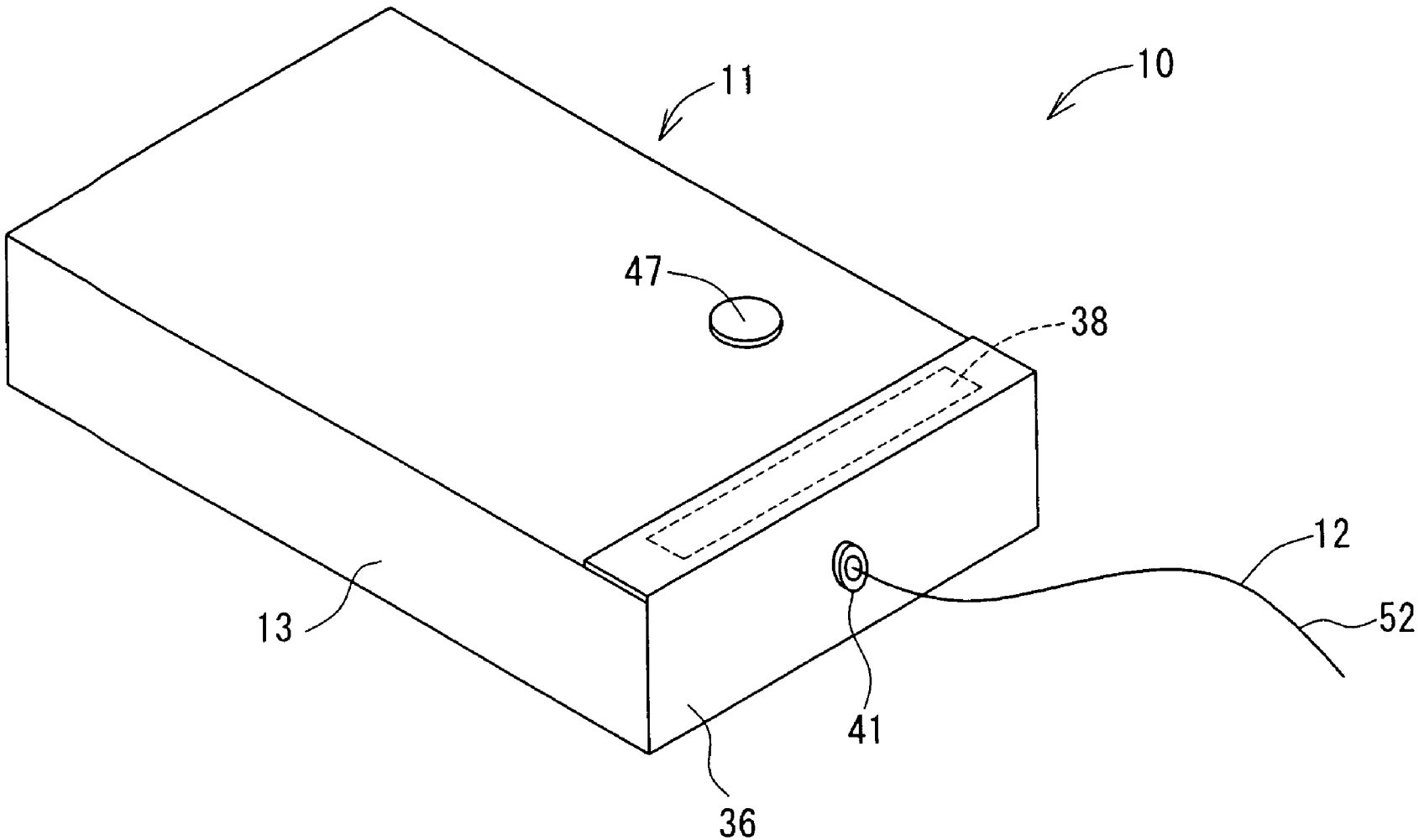
FIG. 1 is a perspective view showing a spool unit according to Embodiment 1 of this invention.
Figure 2:
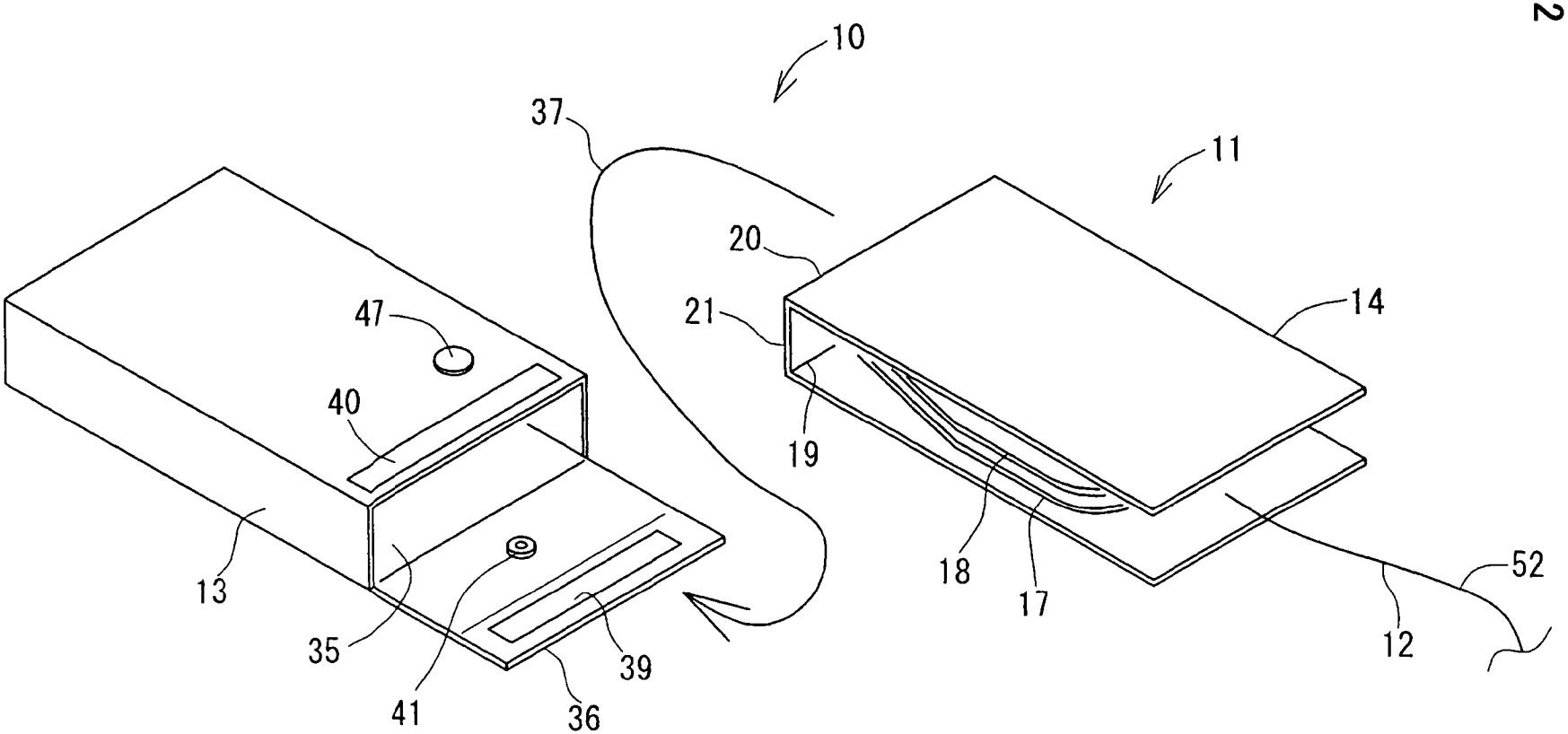
FIG. 2 is an exploded perspective view showing the spool unit according to Embodiment 1 of this invention.
Figure 3:
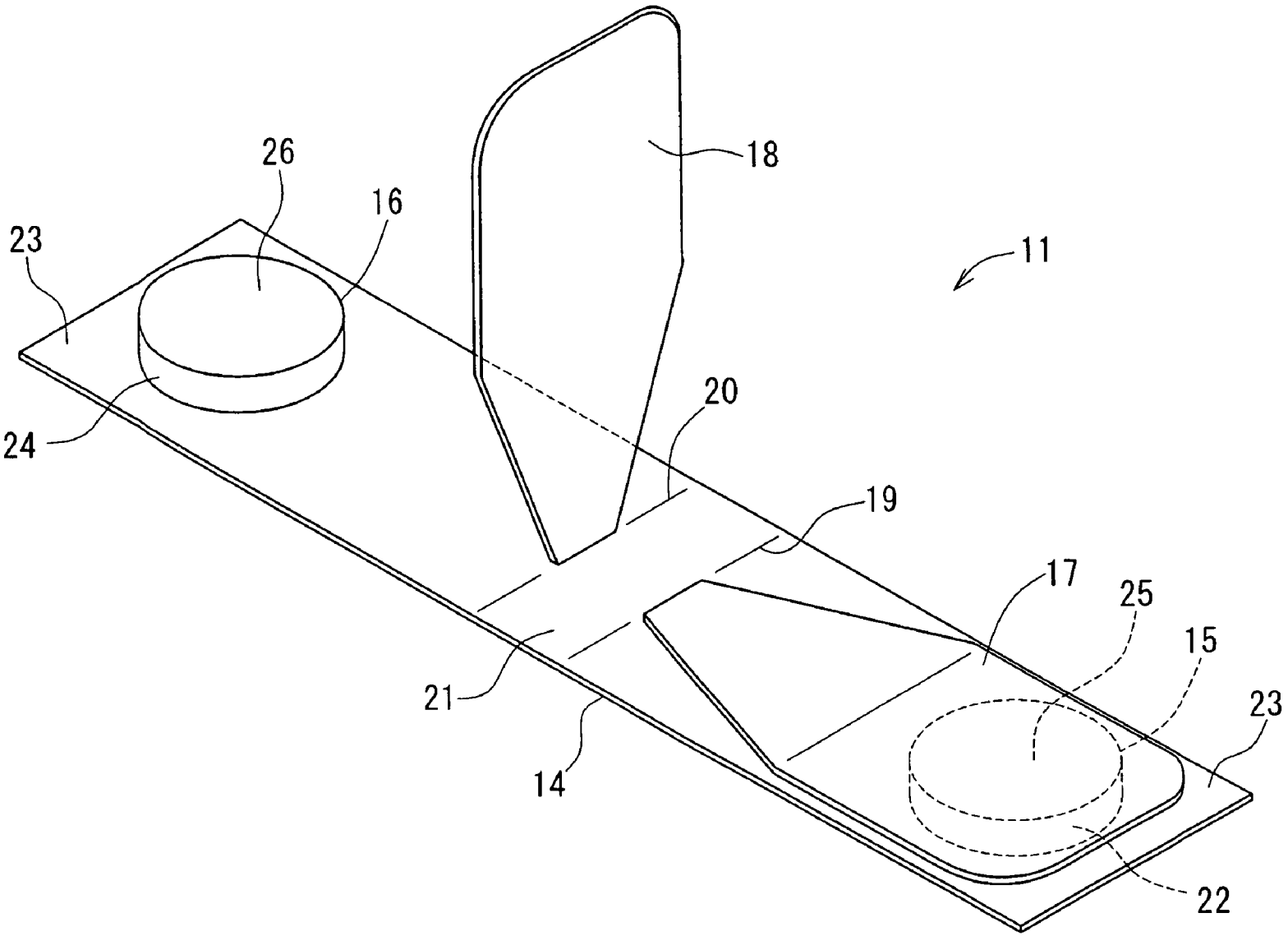
FIG. 3 is an enlarged perspective view showing a spool according to Embodiment 1 of this invention.
Figure 4:
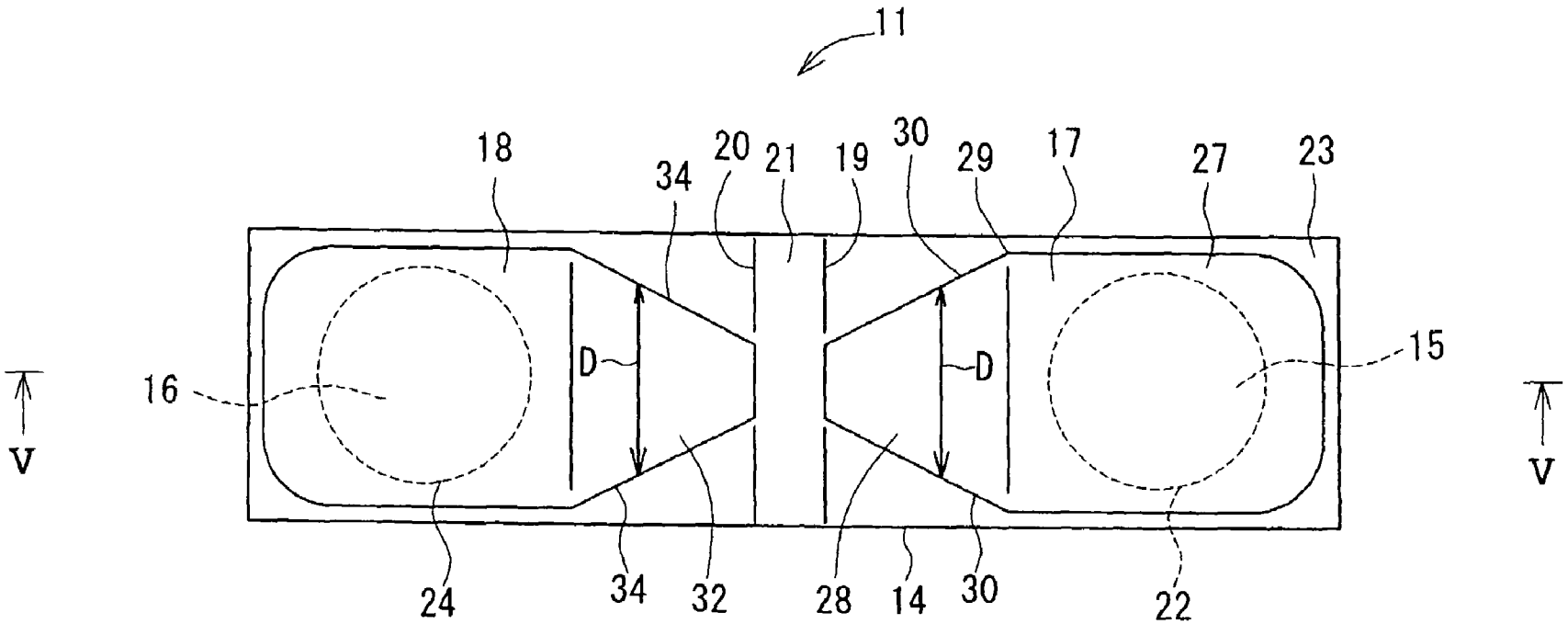
FIG. 4 is a plan view showing the spool according to Embodiment 1 of this invention.
Figure 5:
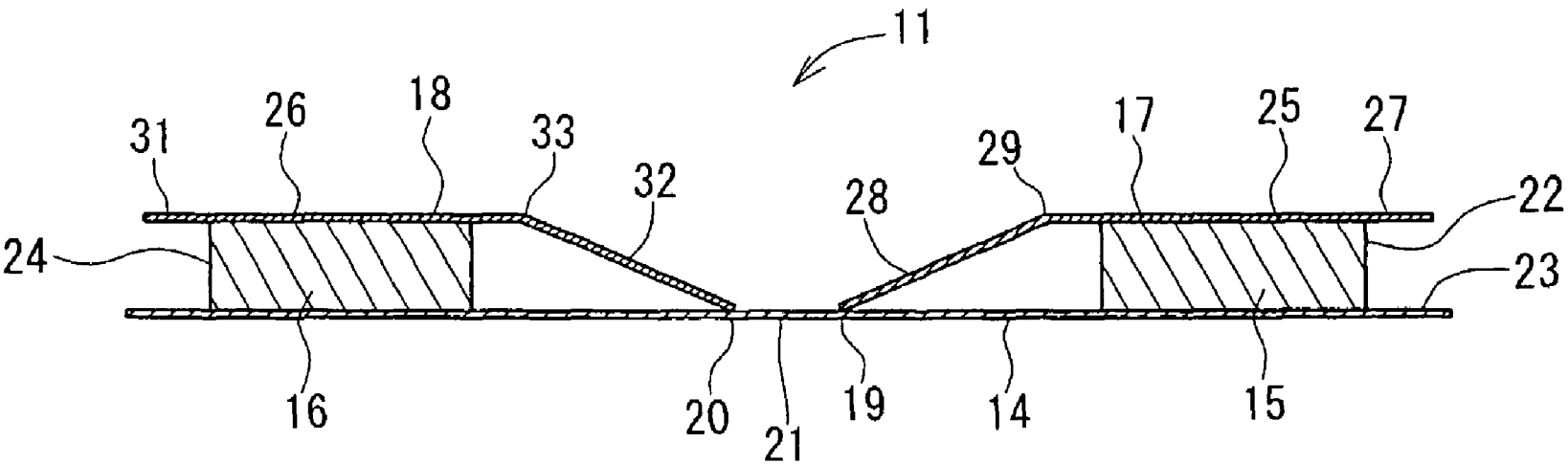
FIG. 5 is a sectional view showing a section taken along the line V-V of FIG. 4.
Figure 6:
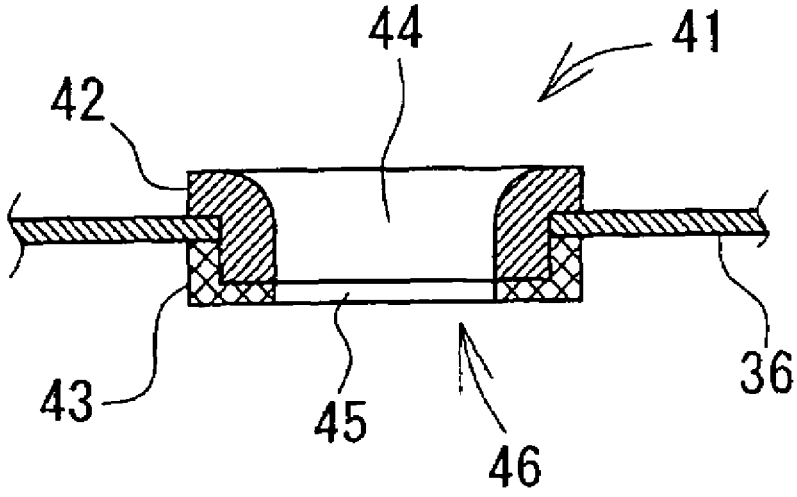
FIG. 6 is an enlarged sectional view showing a main part of the front cover of the spool according to Embodiment 1 of this invention.
Figure 7:
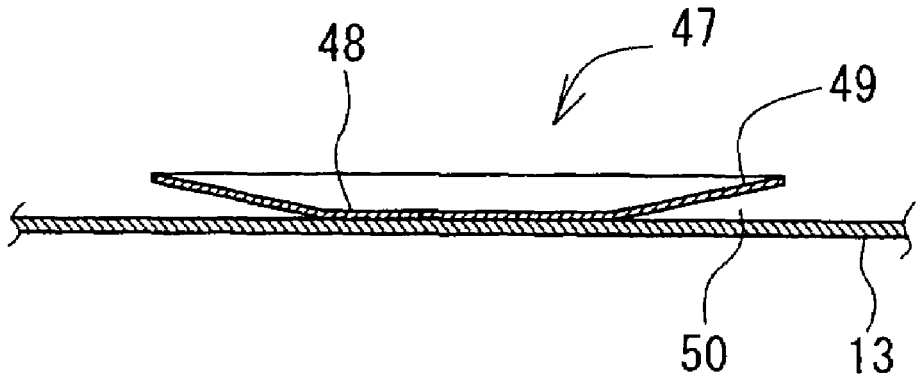
FIG. 7 is an enlarged sectional view showing a casing of the spool according to Embodiment 1 of this invention.
Figure 8:
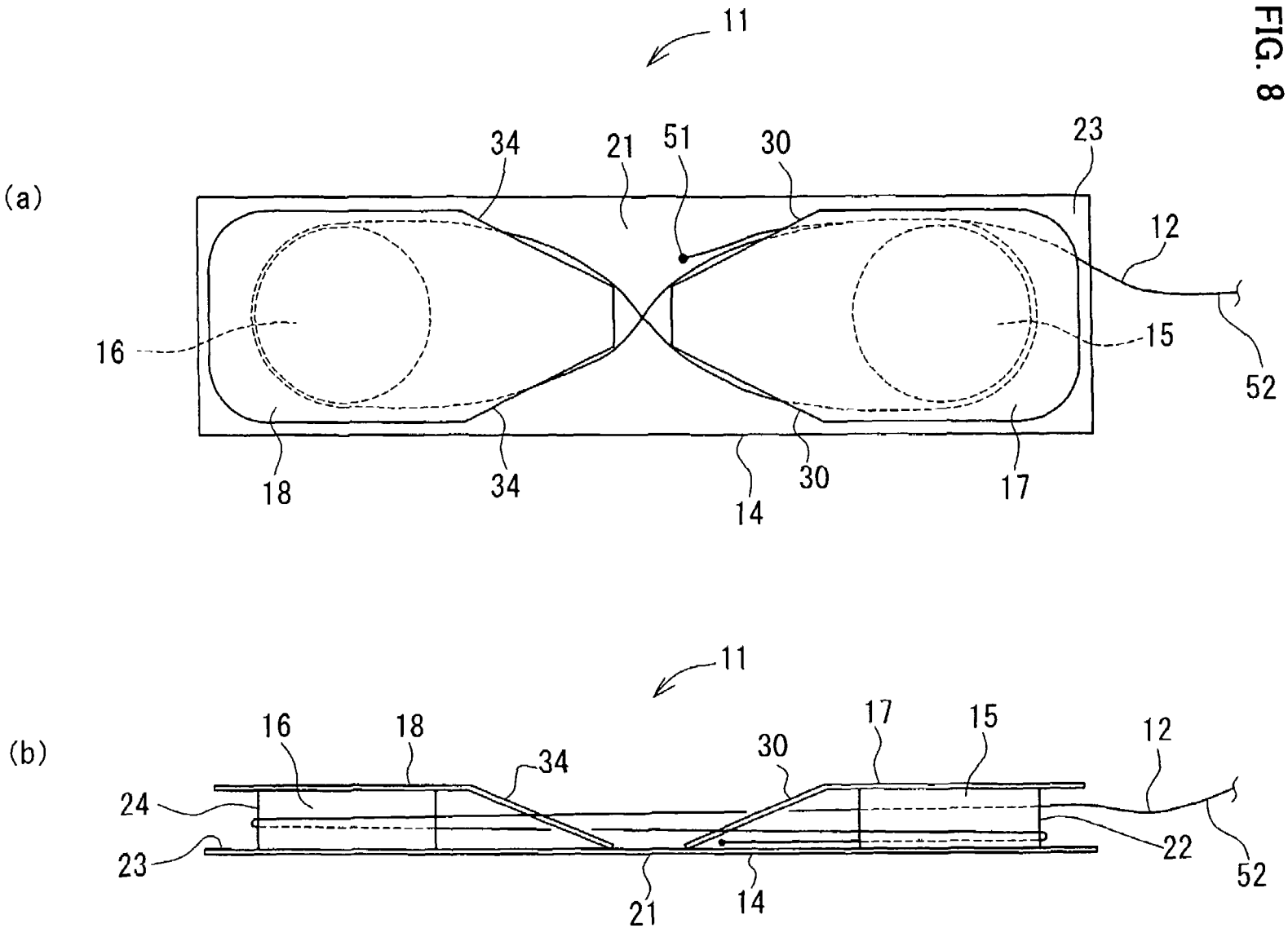
FIG. 8 is a diagram schematically showing a winding process of a thread-like substance of the spool according to Embodiment 1 of this invention.
Figure 9:
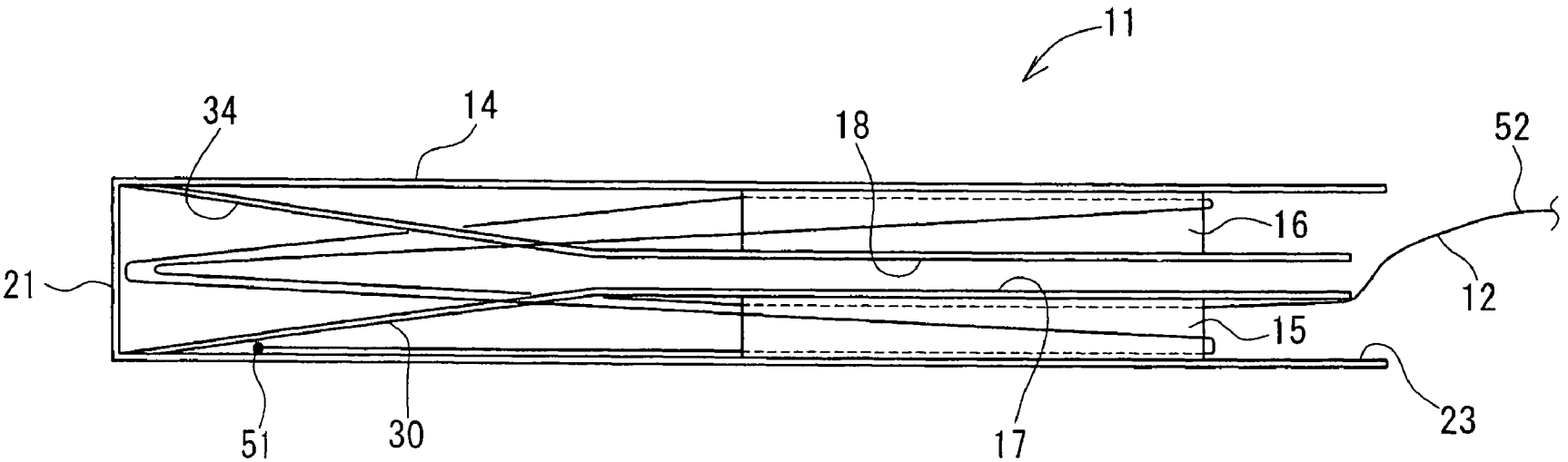
FIG. 9 is a side view showing the spool according to Embodiment 1 of this invention.
Figure 10:
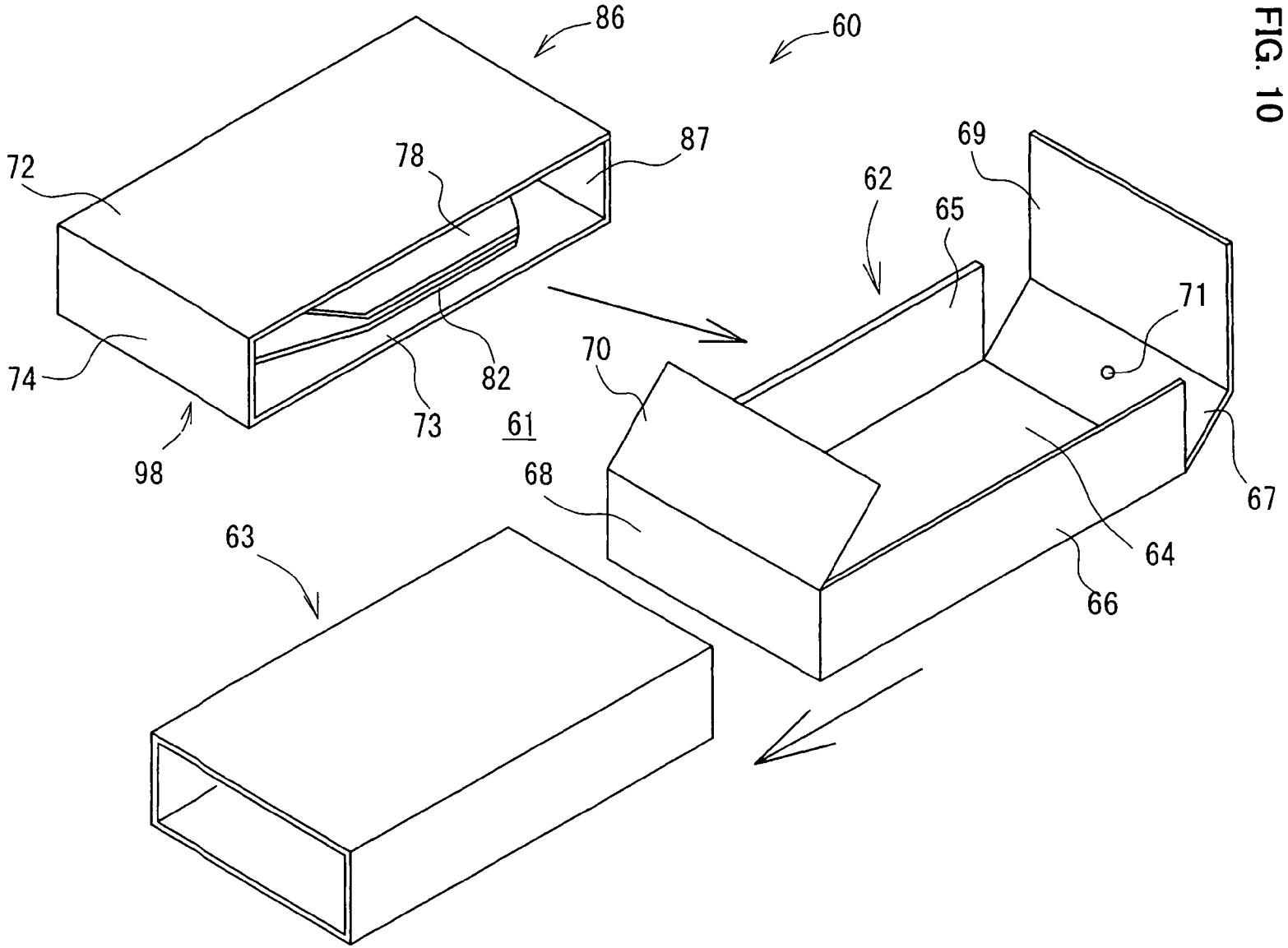
FIG. 10 is an exploded perspective view showing a spool unit according to Embodiment 2 of this invention.
Figure 11:
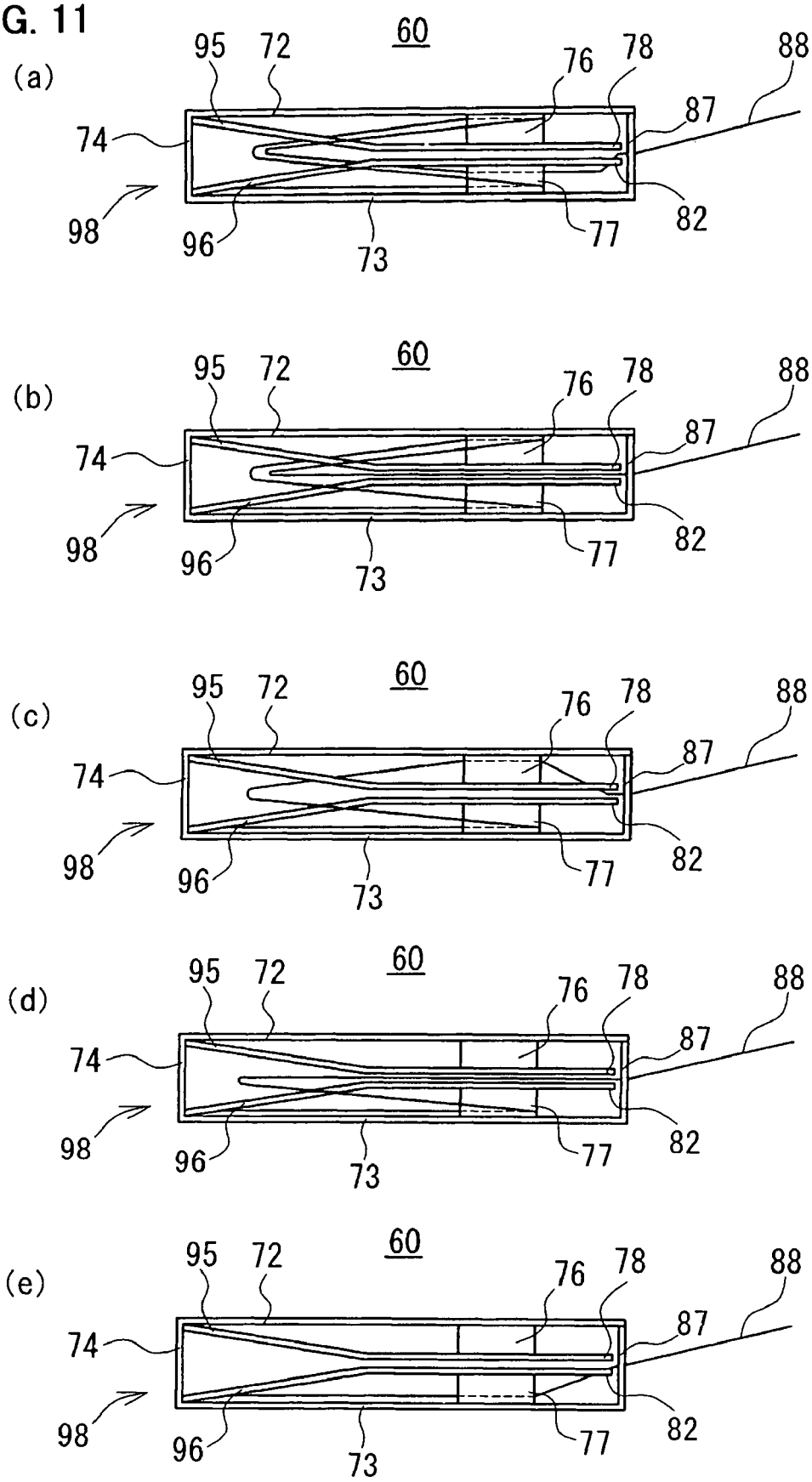
FIG. 11 is a diagram showing a process of unraveling a thread from a spool according to Embodiment 2 of this invention.
Figure 12:
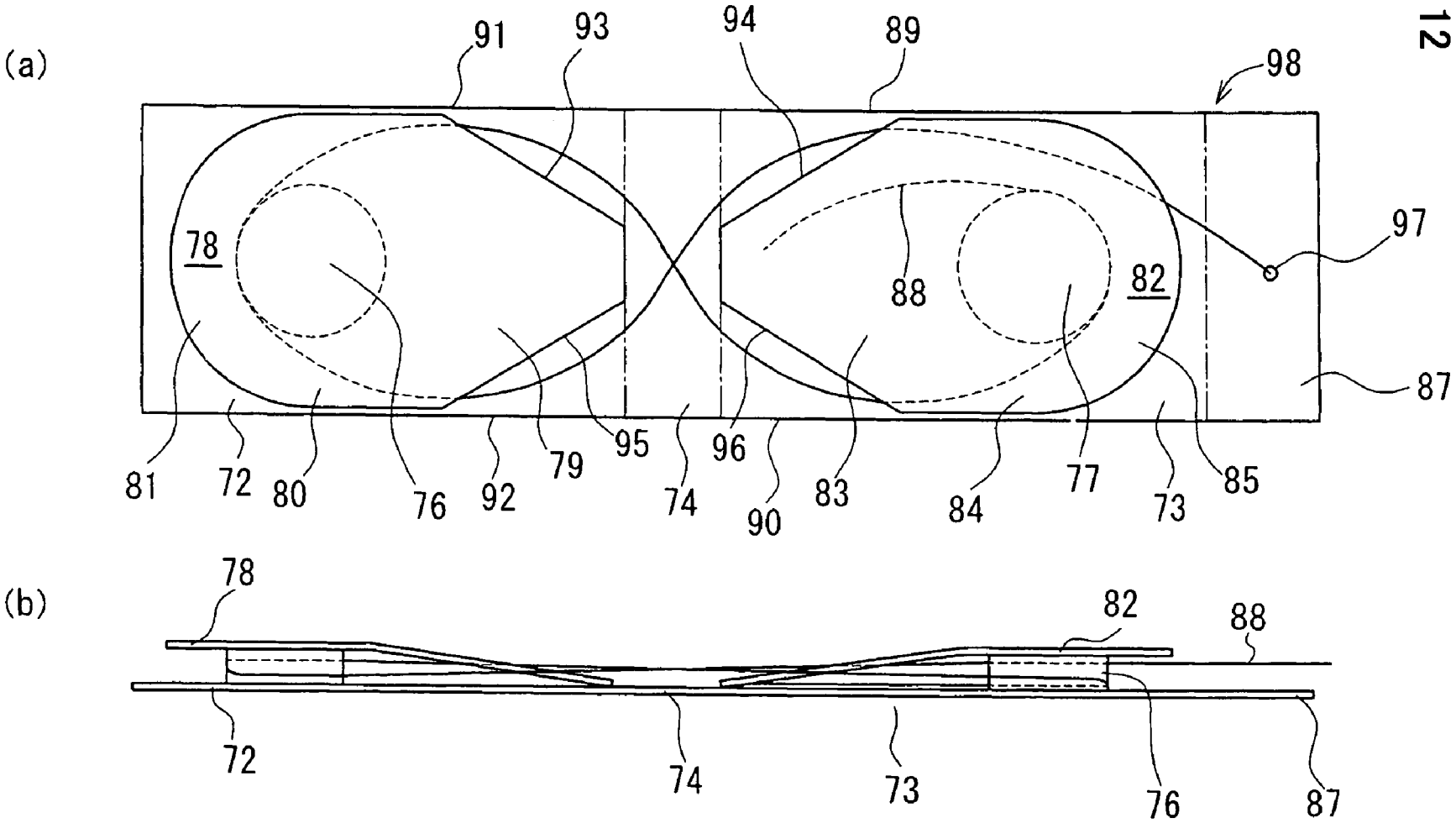
FIG. 12 is a diagram showing a state in which a main body of a spool according to Embodiment 2 of this invention is expanded.
Figure 13:
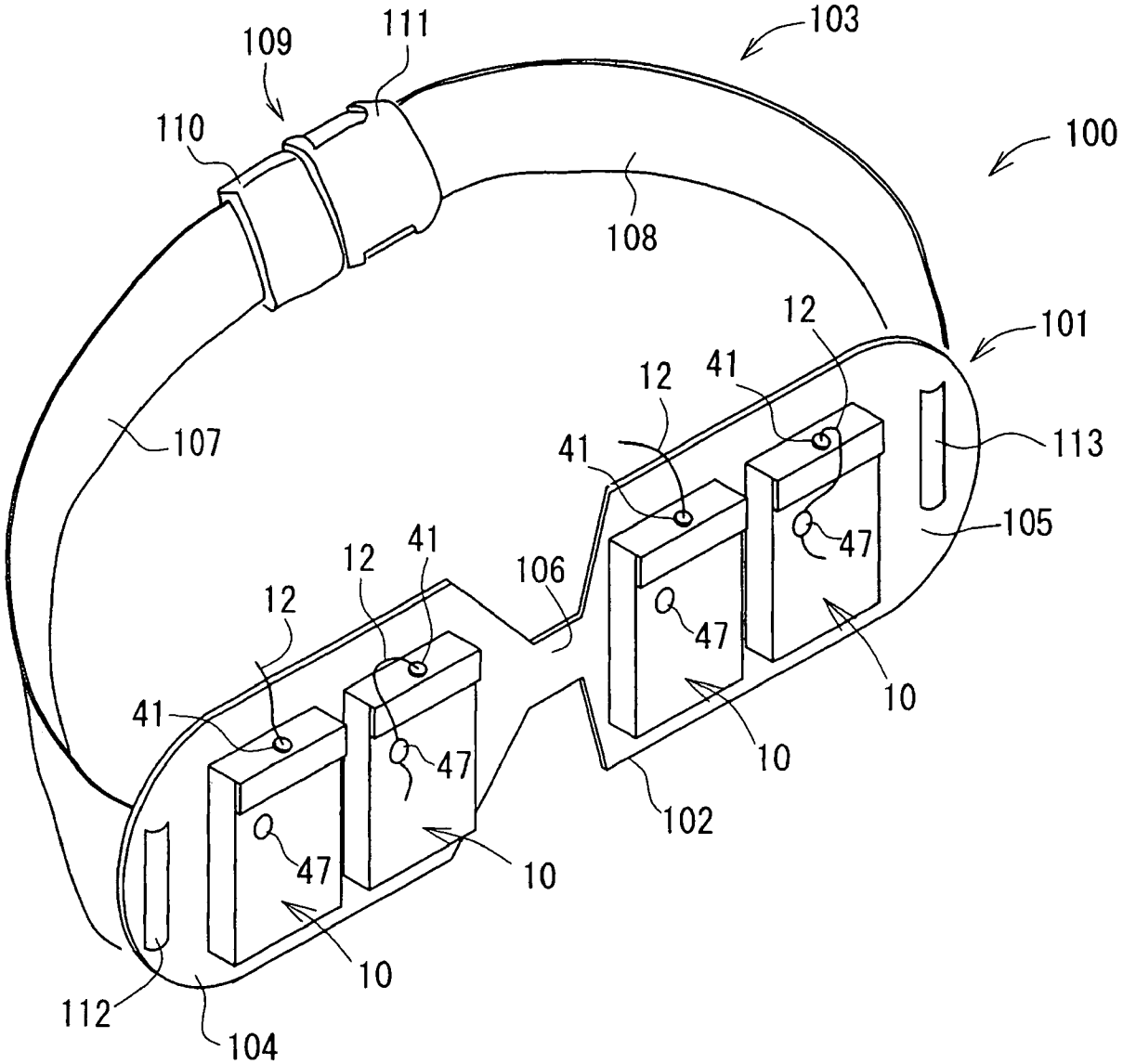
FIG. 13 is a perspective view showing a spool unit according to Embodiment 3 of this invention.

10: spool unit
11: spool
12: thread-like substance
13: casing
14: base plate
15: thread retaining member
16: thread retaining member
17: auxiliary plate
18: auxiliary plate
21: central portion
22: peripheral surface

23: inner surface
24: peripheral surface
25: end face
26: end face
27: flange portion
28: fixing portion
30: side rim
31: flange portion
32: fixing portion
34: side rim
41: guide ring
44: through hole
45: through hole
46: insertion hole
51: one end of thread-like substance
52: other end of thread-like substance
60: spool unit
61: case
72: upper wall (first main wall)
73: lower wall (second main wall)
74: end wall (connector)
76: short cylindrical member (first projection)
77: short cylindrical member (second projection)
78: tongue member (first piece member)
82: tongue member (second piece member)
86: spool
98: main body

The invention claimed is:

1. A spool comprising:

a base plate in the form of an elongated rectangle having a central portion and end portions and capable of changing its posture between a folded posture in which the base plate is bent at the central portion so that the end portions are opposed to each other and an expanded posture in which the end portions depart from each other symmetrically;

a pair of thread retaining members disposed on the end portions of the base plate in such a fashion as to be opposed to each other when the base plate is in the folded posture, each of which is in the form of a column with the peripheral surface being in the form of a circular arc; and, an auxiliary plate being provided on each of end faces of the thread retaining members that are opposed to each other when the base plate is in the folded posture, wherein the auxiliary plate has flange portions and fixing portions, the flange portions being fixed to the end faces of the thread retaining members and one end of each of the fixing portions being formed continuously from the flange portion; and, each of the fixing portions extends from the flange portion in a longitudinal direction of the base plate so that the other end is fixed to the central portion of the base plate, a length of each of the fixing portions in a direction orthogonal to the longitudinal direction of the base plate being reduced gradually toward the center of the base plate.

2. A spool comprising:

a main body of which a first main wall and a second main wall are disposed in parallel to each other, one end of the first main wall and one end of the second main wall are connected to each other by a connector, the other end of the first main wall and the other end of the second main wall serve as open ends;

a first projection member disposed on an inner surface of the first main wall and projected toward the second main wall, of which at least a portion near the open end is curved to project toward the open end;

a second projection member disposed on an inner surface of the second main wall and projected toward the first main wall, of which at least a portion near the open end is curved to project toward the open end;

a first piece member extending from the connector on the inner surface of the first main wall toward the open end, of which a back surface on an intermediate portion is connected to a projected end face of the first projection member, a front rim near the open end is curved to project toward the open end, and at least a tip portion near the open end is flexible; and a second piece member extending from the connector on the inner surface of the second main wall toward the open end, of which a back surface on an intermediate portion is connected to a projected end face of the second projection member, a front rim near the open end is curved to project toward the open end, and at least a tip portion near the open end is flexible.

3. A spool unit comprising:

a base plate in the form of an elongated rectangle having a central portion and end portions and capable of changing its posture between a folded posture in which the base plate is bent at the central portion so that the end portions are opposed to each other and an expanded posture in which the end portions depart from each other symmetrically;

a pair of thread retaining members disposed on the end portions of the base plate in such a fashion that the thread retaining members are opposed to each other when the base plate is in the folded posture, each of which is in the form of a column with the peripheral surface being in the form of a circular arc;

an auxiliary plate being provided on each of end faces of the thread retaining members that are opposed to each other when the base plate is in the folded posture;

a long thread-like substance;

at least one casing for housing and retaining the thread-like substance, the thread retaining members, and the base plate with the base plate being in the folded posture; and a guiding member for guiding the thread-like substance from inside to outside of the casing, wherein the auxiliary plate has flange portions and fixing portions, the flange portions being fixed to the end faces of the thread retaining members and one end of each of the fixing portions being formed continuously from the flange portion; and each of the fixing portions extends from the flange portion in a longitudinal direction of the base plate so that the other end is fixed to the central portion of the base plate, a length of each of the fixing portions in a direction orthogonal to the longitudinal direction of the base plate being reduced gradually toward the center of the base plate; and, the thread-like substance is wound on one of the thread retaining members and subsequently on the other thread retaining member in a state where the base plate is in the expanded posture so that the thread-like substance is wound on the pair of thread retaining members as being crossed between the pair of thread retaining members.

4. The spool unit according to claim 3, further comprising:

an attachment member to which the at least one casing is attached and a retaining belt which is fixed on a hip of a user of the threadlike substance so as to allocate the attachment member on an abdominal part of the user.

* * * * *